United States Patent [19]

Pennock

[11] 4,440,341

[45] Apr. 3, 1984

[54] RETURN ENVELOPE MAILER

[75] Inventor: Thomas G. Pennock, North Tonawanda, N.Y.

[73] Assignee: Moore Business Forms, Inc., Grand Island, N.Y.

[21] Appl. No.: 438,787

[22] Filed: Nov. 3, 1982

[51] Int. Cl.[3] ..... B65D 27/10

[52] U.S. Cl. ..... 229/69; 229/73

[58] Field of Search ..... 229/69, 73; 282/11.5 R, 282/11.5 A, 25

[56] References Cited

U.S. PATENT DOCUMENTS

| | | | |
|---|---|---|---|
| 1,279,171 | 9/1918 | Sullivan | 229/69 |
| 2,824,685 | 2/1958 | Patton | 229/69 |
| 3,026,018 | 3/1962 | Stratton et al. | 229/69 |
| 3,058,648 | 10/1962 | Alexander | 229/73 |
| 3,104,799 | 9/1963 | Steidinger | 282/25 |
| 3,261,623 | 7/1966 | Kiedrowski | 282/25 |
| 3,294,423 | 12/1966 | Mudd | 282/25 |
| 3,482,763 | 12/1969 | Carrigan | 229/69 |
| 3,554,438 | 1/1971 | Van Malderghem | 229/69 |
| 3,786,984 | 1/1974 | Malenge | 229/69 |
| 3,837,565 | 9/1974 | Johnsen | 229/68 R |
| 4,081,127 | 3/1978 | Steidinger | 229/69 |

FOREIGN PATENT DOCUMENTS

| | | | |
|---|---|---|---|
| 15557 | of 1903 | United Kingdom | 229/69 |

*Primary Examiner*—Stephen P. Garbe

*Attorney, Agent, or Firm*—Allegretti, Newitt, Witcoff & McAndrews, Ltd.

[57] ABSTRACT

A continuous business form assembly includes webs defining return envelopes within originating envelopes, where the webs of the originating envelopes are joined through openings in the other webs. The flaps of the return envelopes are formed of the material from which the openings are cut so that the flaps and openings are simultaneously created, paper waste is reduced and return envelope size increased.

6 Claims, 3 Drawing Figures

RETURN ENVELOPE MAILER

BACKGROUND OF THE INVENTION

This invention relates to a continuous business form assembly, and more particularly, to a continuous, filled envelope assembly, or, in business jargon, a return envelope mailer.

As computer printing has facilitated computer billing and the like, the use of continuous business form assemblies has increased. For computer billing and the like, such assemblies have typically included multiple, overlying webs with marginal feed strips. The webs form series of overlying record sheets, originating envelopes, return envelopes, and message sheets. The return envelopes and message sheets are contained within the originating envelopes. The return envelopes and message sheets are removed from the originating envelopes by their first recipients, who separate the assembly along perforation lines as provided. The webs which form the return envelopes and message sheets include spaced, transversely extending openings between the feed strips, which allow the webs which form the originating envelopes to be joined, in part, through the openings and about the return envelopes and message sheets.

While these assemblies have proven successful, the need to provide the return envelopes with a flap or alternate sealing means has been a problem. The dimensions of the envelopes have been limited by this need.

SUMMARY OF THE INVENTION

With the problems of return envelopes within continuous business form assemblies at hand, this invention proceeds with the discovery of an alternate continuous business form construction which not only increases the possible size of return envelopes for any given assembly but also simultaneously eliminates the paper waste of the openings cut through the one of the webs from which the flaps of the return envelopes are formed.

In a principal aspect, this invention is a continuous business form assembly of the type described, in which the flaps of the return envelopes are formed in one web of the material from which the web openings in that web are cut, rather than being formed of the material of the sheets which remain after the openings are cut. The openings of the one web are cut, and the flaps of the return envelopes are formed simultaneously, by the making of two spaced, short, longitudinal cuts and a single, long, transverse cut between the two longitudinal cuts. These cuts simultaneously define three edges of the openings in the web being cut, and three edges of the flaps. The flaps and openings are then completed by a folding of the flaps back against the web along a transverse fold or perforation line.

In another principal aspect, this invention is, in claim language, a continuous business form assembly comprising a web having a longitudinal extent, a transverse extent, and longitudinally spaced, transversely extending flaps. The flaps each have cut edges and a folded edge, the flaps being folded and thereby defining openings in the web adjacent the flaps.

Figure 1:
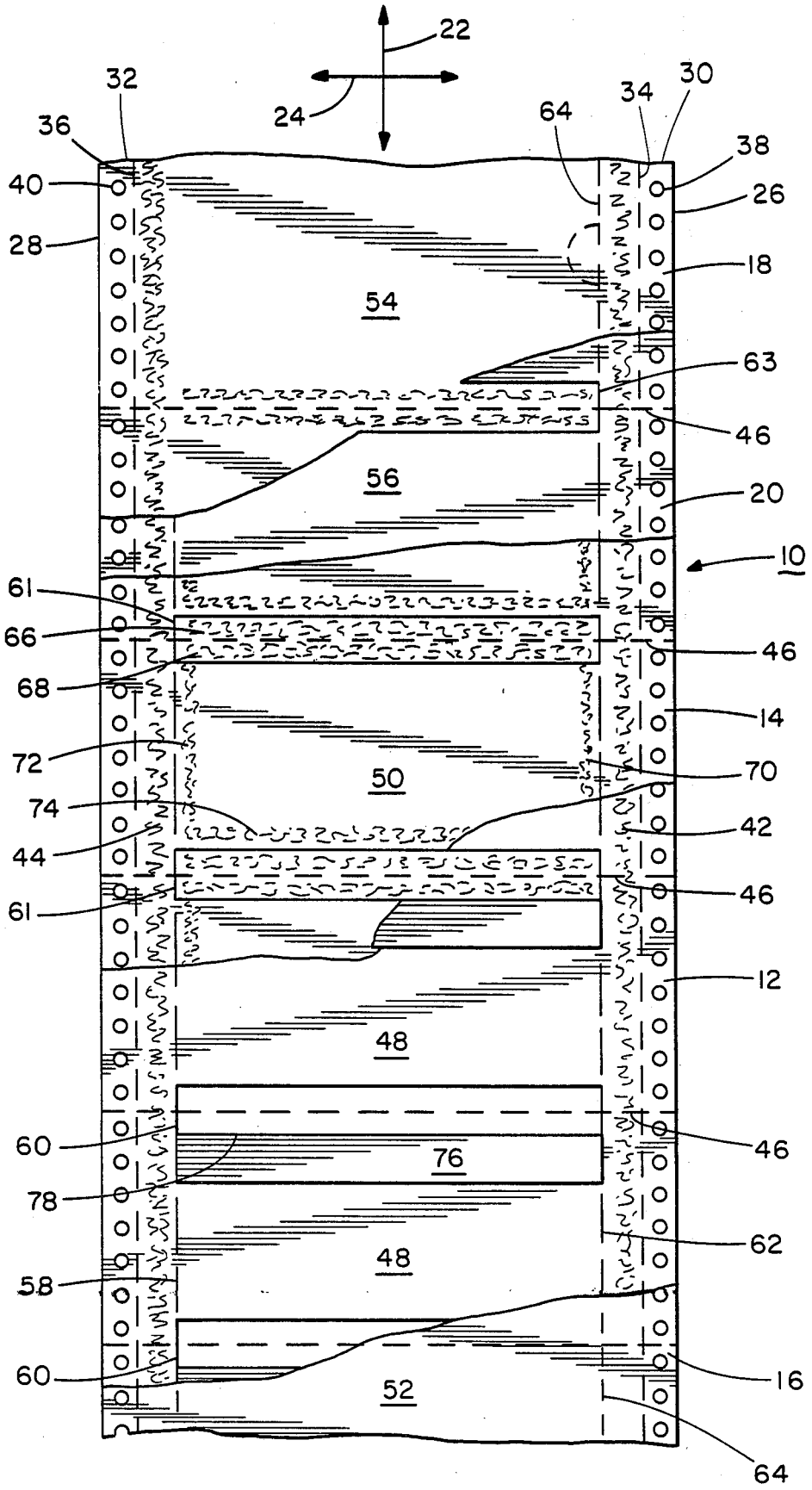
FIG. 1 is a progressively cutaway view of the preferred embodiment of the invention.
Figure 2:
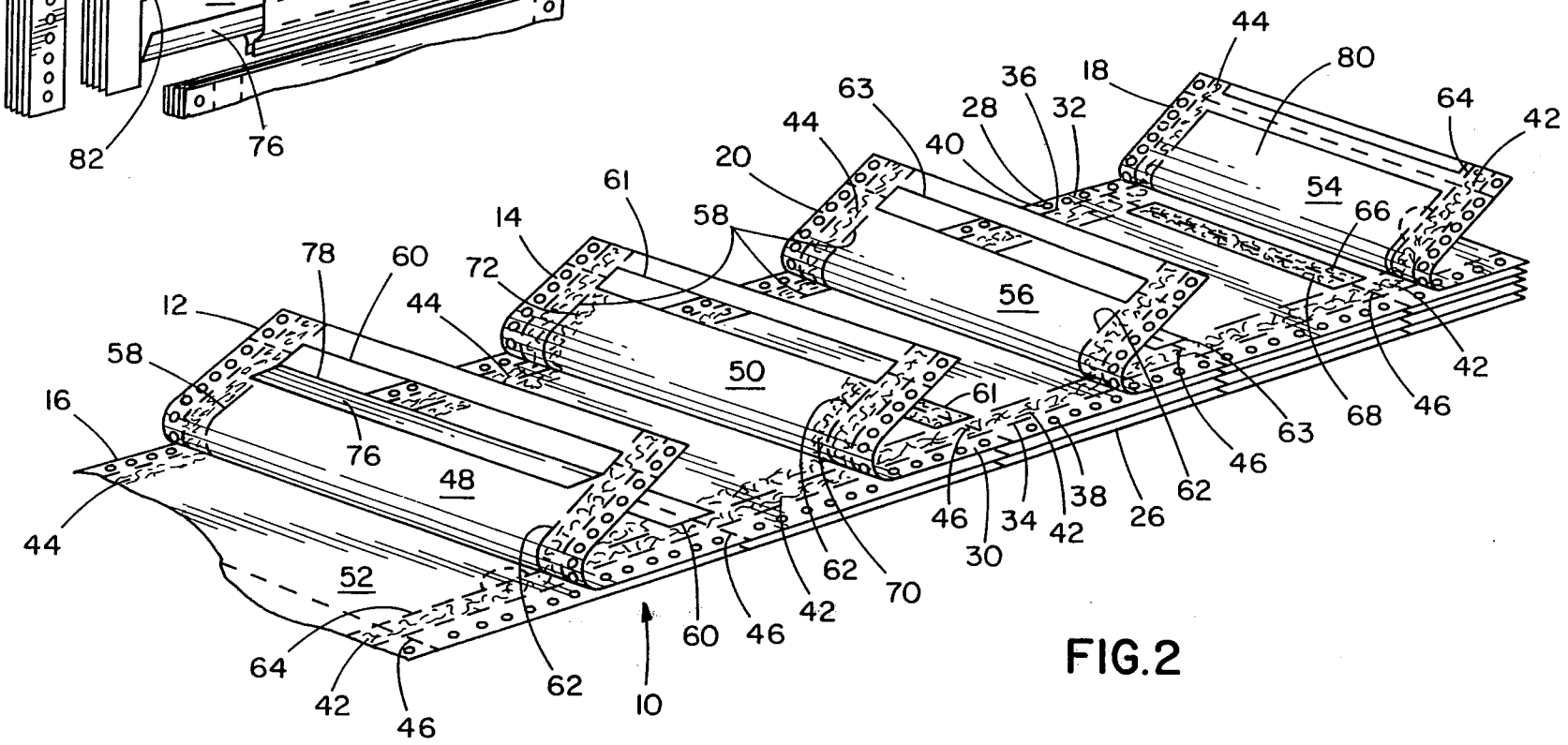
FIG. 2 is a perspective view of the preferred embodiment with its webs progressively peeled back.

Also in the drawing, and the description which follows, construction details of the preferred embodiment which are repeated in series and repeated among the webs in overlying relationships, are given a single reference number, despite the repetition, for clarity.

DETAILED DESCRIPTION OF THE PREFERRED EMBODIMENT

Referring to the figures of the drawing, the preferred embodiment of the invention is a continuous business form assembly 10. The assembly includes five webs, specifically a first web 12, a second web 14, a third web 16, a fourth web 18, and a fifth web 20. In order from the top of FIG. 1, the webs are 18, 20, 14, 12, 16.

Each web 12–20 has a longitudinal extent along its direction of continuity 22, and a transverse extent along a transverse direction 24 perpendicular to the direction 22. Along transversely marginal, longitudinally extending (i.e., marginal) edges 26, 28 of the assembly 10, each web 12–20 has marginal feed strips 30, 32, respectively, defined by marginal perforation lines 34, 36 and marginal rows of spaced feed holes 38, 40, respectively. Longitudinal first and second glue lines 44, 42, which are a type of means for joining the webs, extend along the inward sides of the marginal perforation lines 34, 36 and join the webs 12–20. Spaced, transverse lines of perforations 46 divide the webs 12–20 into sheets or panels 48, 50, 52, 54, 56, respectively.

Inward of the first glue line 44, the webs 12, 14, 20 have perforation lines 58 interrupted by openings 60, 61 and 63, respectively. Inward of the second glue line 42, the webs 12, 14, 20 have perforation lines 62, also interrupted by the openings 60, 61, 63 and the webs 16, 18 have continuous perforation lines 64.

The openings 60, 61, 63 are centered on the transverse perforation lines 46, and extend transversely from the perforation lines 58 to the perforation lines 62. Glue lines 66, 68 join the webs 16, 18 through the openings 60, 61, 63 along both sides of the transverse perforation lines 46. The glue lines 66, 68 combine with the glue lines 42, 44 to form originating envelopes 69 (FIG. 3) of the panels 52, 54, which contain the panels 48, 50, 56 of the webs 12, 14, 20, respectively.

Thus, the panels 48, 50, 56 are the contents of the originating envelopes 69. Panel 56 is a message sheet, which may be a bill, notice or the like. Panels 48, 50 form a return envelope 51, as will now be described.

Panels 48 have a longitudinal extent from one opening 60 to an adjacent opening 60; panels 50 have a longitudinal extent from one opening 61 to an adjacent opening 61; and panels 56 have a longitudinal extent from one opening 63 to an adjacent opening 63. The longitudinal extents of the panels 50, 56 are substantially identical to each other, and about one-eighth inch less than that of the panels 48, for clearance of a flap 76. The openings 61, 63 are substantially aligned longitudinally and transversely, with the openings 60. Along the inner sides of the perforation lines 58, 62, and on the face toward panel 48, panel 50 has longitudinal glue lines 70, 72. Along one of its adjacent openings 61 and on the same face, the panel 50 further has a transverse glue line 74. The glue lines 70, 72, 74 join the panels 48, 50 along three of their sides, forming a pocket.

On its face away from the panel 50, and at its transverse edge opposite the glue line 74, the panel 48 has the flap 76. The flap 76 is folded back against the panel 48 along a fold line 78. The edge of the opening 60 in the web 12 adjacent the flap 76 is formed by the fold line 78, and the transverse and longitudinal extents of the flap 76 equal the transverse and longitudinal extents, respectively, of the opening 60.

These relationships exist between the flap 76 and opening 60 because the two are simultaneously formed, and the flap 76 is integral to the web 12. The two transverse and one longitudinal edges of the flap 76 and of the opening 60 in the web 12 are formed by cutting, or slitting, of the web 12. The other longitudinal edge of the flap 76 and of the opening 60 is defined by the fold line 78, as the flap 76 is folded back.

The panels 48, 50 thus form the return envelope 51, with an integral, top opening flap 76.

As now described, the assembly 10 provides continuous series of originating envelopes 69, message sheets 56 and return envelopes 51. For computer printing, a carbon backing 80 is provided on the panels 54. The units of the envelopes 51, 69 and sheets 56 may be printed, separated as in FIG. 3 from adjacent units and their feed strips 30, 32, and then sent.

Figure 3:
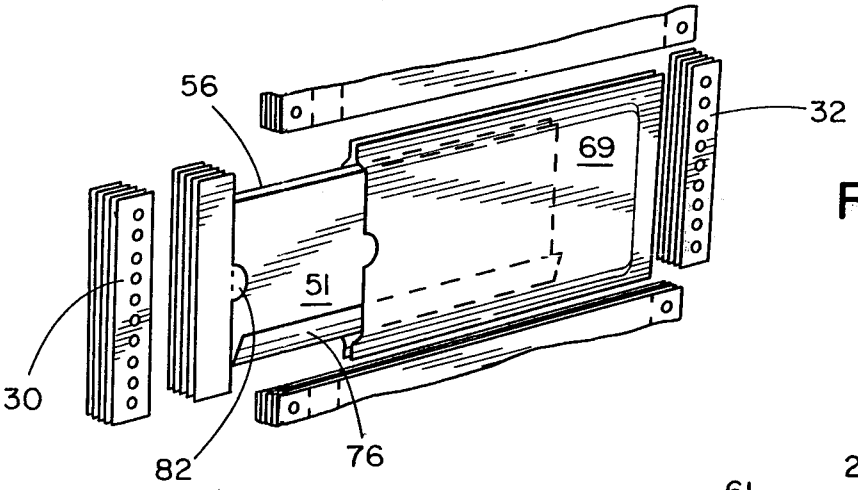
FIG. 3 is a perspective view of a single one of the series of message and envelope units formed by the preferred embodiment, as separated from its adjacent units and burst apart during use.

Upon receipt, the envelopes 69 may be opened by transverse stress using thumb notches 82, again as in FIG. 3. The contents 51, 56 may then be pulled from the envelopes 69 and used. If the flap 76 has been prepared with an adhesive for the recipient, the return envelope 51 may be readily sealed and returned to the originator.

The invention, the preferred embodiment and the manner and process of making and using the invention have now been described in such full, clear, concise and exact terms as to enable any person skilled in the art to make and use the same. The best mode contemplated by the invention of carrying out the invention has been set forth.

To particularly point out and distinctly claim the subject matter regarded as invention, the following claims conclude this specification.

What is claimed is:

1. A continuous business form assembly comprising a first web, a second web, a third web and a fourth web, all the webs being continuous in a longitudinal direction, and having a transverse extent perpendicular to the longitudinal direction, the first web also having longitudinally spaced, transversely extending flaps, the flaps each having cut edges and a folded edge, the flaps being folded and thereby providing openings in the first web adjacent the flaps, the second web having openings longitudinally and transversely substantially aligned with the openings of the first web, the second web being joined to the first web to form return envelopes such that the flaps are return envelope flaps, and the third web being joined to the fourth web, in part through the openings of the first and second webs, and the third and fourth webs being adapted to form originating envelopes including therein the return envelopes.

2. A continuous business form assembly as in claim 1 in which the longitudinal extent of the return envelope flaps equals the longitudinal extent of the openings in the first web.

3. A continuous business form assembly as in claim 1 in which the transverse extent of the return envelope flaps equals the transverse extent of the openings in the first web.

4. A continuous business form assembly as in claim 1 in which all the webs include transverse perforation lines adjacent the openings which divide all the webs into sheets.

5. A continuous business form assembly as in claim 1 in which the return envelope flaps are folded along the folded edges flat against the first web.

6. A continuous business form assembly as in claim 1 in which the first and second webs include return envelope panels with the folded edges of the return envelope flaps forming first edges of the return envelope panels of the first web, the return envelope panels of the first and second webs having other edges and each return envelope panel of the first web being joined to a return envelope panel of the second web along the other edges.

* * * * *